United States Patent [19]

Yale

[11] Patent Number: 4,985,817

[45] Date of Patent: Jan. 15, 1991

[54] SUPPORTING DEVICE FOR TROUBLE LIGHT

[76] Inventor: Paul-Aimé Yale, Chemin du Tour du Lac, Lac-des-Iles, Quebec J0W 1J0, Canada

[21] Appl. No.: 519,639

[22] Filed: May 7, 1990

[51] Int. Cl.[5] ..... F21V 21/08; F21L 15/14; F21L 15/18

[52] U.S. Cl. ..... 362/396; 362/191; 362/398; 248/206.5; 248/316.7; 248/684

[58] Field of Search ..... 362/396, 398, 191; 248/206.5, 316.7, 684

[56] References Cited

U.S. PATENT DOCUMENTS

| | | | |
|---|---|---|---|
| 2,506,400 | 5/1950 | Wietz | 362/398 X |
| 2,778,931 | 1/1957 | Cruz | 362/396 X |
| 2,987,612 | 6/1961 | Haulter | 362/398 X |
| 3,177,358 | 4/1965 | Suttie | 362/296 |
| 4,678,153 | 7/1987 | Maddock et al. | 362/396 X |
| 4,727,462 | 2/1988 | Komonko | 362/398 |
| 4,895,329 | 1/1990 | Sloan | 248/316.7 X |
| 4,907,769 | 3/1990 | Hunley, Jr. et al. | 248/316.7 X |

*Primary Examiner*—Stephen F. Husar
*Assistant Examiner*—Peggy Neils
*Attorney, Agent, or Firm*—Roland L. Morneau

[57] ABSTRACT

A supporting device for trouble light is made of a plate member having a magnetized surface and a clip member projecting away from the magnetized surface. The clip member is made of a continuous resilient wire generally defining a M-shape having two lateral portions fixed on diametrically opposed sides of the plate member. The intermediate portion of the wire between the lateral portions defines a round recess with a narrowing gap adjacent the lateral portions for allowing access of the handle of the trouble light. The gap defines a distance smaller than the diameter of the round recess which resiliently spreads when the handle is introduced in or removed from the recess. The lateral portions are held by grooved wings on opposite sides of the plate member and by radially projecting ends inserted in the plate member.

8 Claims, 1 Drawing Sheet

SUPPORTING DEVICE FOR TROUBLE LIGHT

BACKGROUND OF THE INVENTION

1. Field of the Invention

The present invention relates to a supporting device for a trouble light and more specifically to a clip fixed to a magnetized plate adapted to grip the trouble light.

2. Prior Art

Various combinations have been foreseen to support a trouble light considering that the latter needs to be supported under various conditions, over a variety of supporting surfaces located at various angles.

In U.S. Pat. No. 2,747,079, Kubiliunas makes use of a wire which clips on the trouble light. The wire is held by the combination of a slip member and a chain held to a magnet adapted to hold the chain and grip onto a metallic surface. The patent is particularly directed to the wire which extends from the handle and runs longitudinally over the light bulb and up to the hook 28. The slip member 34 is adapted to slide over the length of the wire 12 in order to maintain the desired equilibrium of the trouble light.

The portable light fixture described in U.S. Pat. No. 3,177,358, includes a network of wire surrounding the light bulb and bent over to form its own support under the light bulb, the support being provided with a magnet which adds retention to the light fixture, as shown in FIG. 4 of the above-mentioned patent.

Canadian patent No. 629,946, makes use of a magnet which is fixed on the outside of the wire cage of a trouble light, the magnet being located along the longitudinal axis of the light bulb.

FIELD OF THE INVENTION

The invention is directed to a supporting device for a trouble light which is separate and distinct from the trouble light and from which the trouble light can be easily clipped and removed.

The present supporting device also allows the trouble light to be oriented in a variety of directions. The trouble light can be rotated around the axis of the light bulb. The supporting device being provided with a magnetize surface can be easily rotated around an axis perpendicular to the axis of the light bulb.

SUMMARY OF THE INVENTION

The support for a trouble light according to the present invention, is the combination of a spring clip with a plate member having a magnetized surface. The spring clip is made of a continuous resilient wire generally defining a M-shape having two lateral portions fixed to the magnetized plate member and an intermediate portion defining a round recess between both lateral portions. The round recess has a narrowing gap adjacent the lateral portions for allowing access of the handle of the trouble light. The gap defines a distance smaller than the diameter of the round recess for allowing the introduction of the handle of the trouble light in the recess by resiliently spreading the gap due to the resiliency of the wire. The lateral portions are terminated by end portions which grip into opposed surfaces of the magnetized plate member. The latter member is provided with grooves in the above-mentioned opposed surfaces to support the lateral portions of the wire. The portion of the recess adjacent the plate member is preferably provided with an outgrowth which is held by a groove provided on the upper surface of the plate member.

The surface of the plate member away from the clip is sufficiently strongly magnetized so as to support the trouble light when the latter is held by the clip.

The magnetized surface is generally flat and is preferably beveled at its periphery for gripping and pulling on the magnetized plate member.

DETAILED DESCRIPTION OF THE INVENTION

Figure 1:
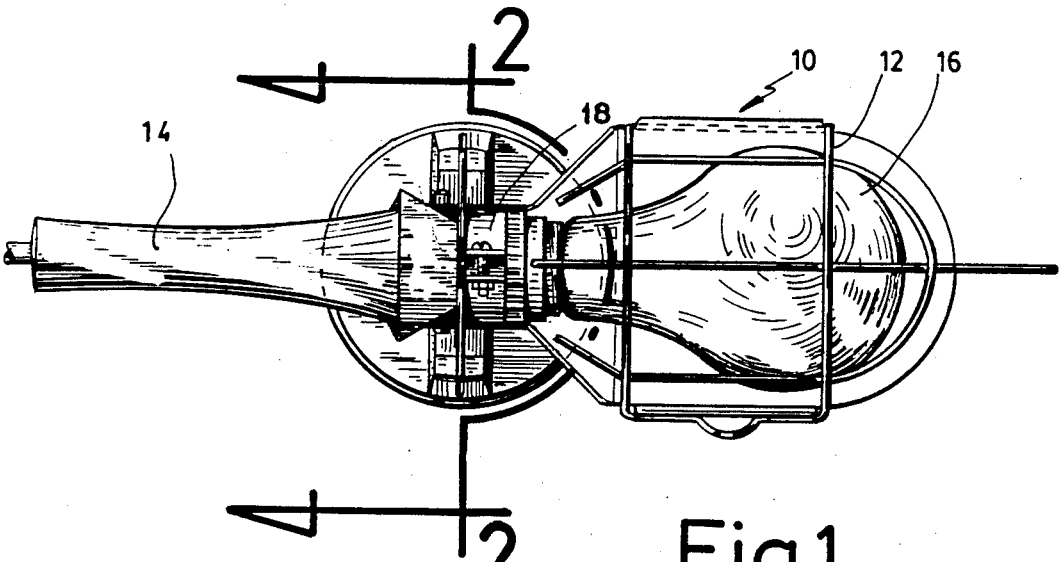
FIG. 1 is a front view of the supporting device, according to the invention supporting a trouble light.
Figure 2:
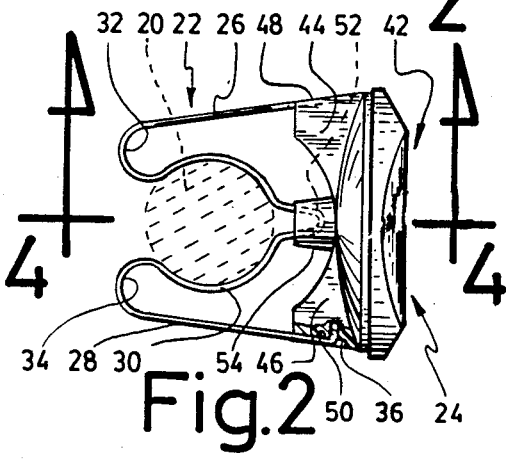
FIG. 2 is a side view of the trouble light along lines 2—2 of FIG. 1.
Figure 3:
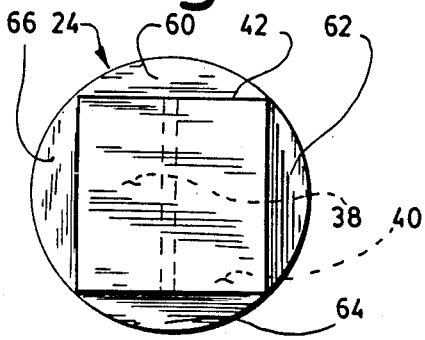
FIG. 3 is a rear view of the supporting device.
Figure 4:
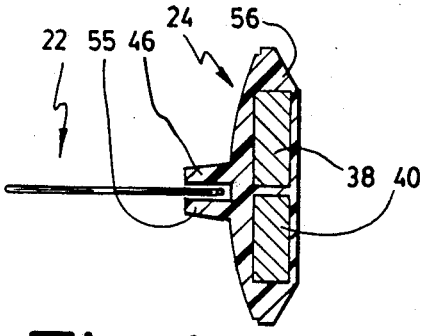
FIG. 4 is a cross-sectional view of the device along lines 4—4 of FIG. 2.
Figure 5:
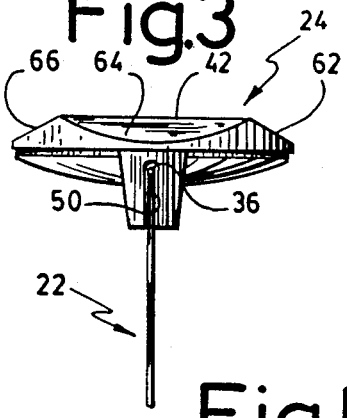
FIG. 5 is a side view of the device at 90° from the view shown in FIG. 2.

FIG. 1 shows a custom made trouble light 10 including a wire cage 12, a handle 14 and a light bulb 16 screwed in a socket 18. The portion connecting the handle 14 and the socket 18 has a generally circular cross-section 20 and is intended to be used as such by the present invention. The circular cross-section 20 which is substantially intermediate between the handle 14 and the socket 18 is schematically shown in FIG. 2 by a circular area covered by dotted lines.

The supporting device, according to the invention includes a spring clip member 22 and a plate member 24 holding the clip member 22. The clip member 22 has the general shape of a M when seen with the base under the clip. It includes two lateral portions 26 and 28 which extends away from the plate 24 in diametrically opposed positions relative to the plate 24. The intermediate portion between the two lateral portions 22 and 24 forms a circular recess. The clip member 22 is generally made of a continuous wire made of spring steel to provide the desired flexibility and resiliency. Other wires such as music wire characterized by standard ASTM 1070-1080 may also be used. The connecting portions 32 and 34 between the lateral portions 22 and 28 and the circular recess 30 forms a narrowing gap which is smaller than the diameter than the circular cross-section 20. The portions 32 and 34 are rounded so as to provide sufficient flexibility for the introduction of the handle 14 in the recess 30 and sufficient tightness to maintain the trouble light inside the recess 30. The circular recess 30 which usually has a diameter of about $1\frac{1}{2}$ inch, a gap of about $\frac{3}{4}$ inch and rounded portions 32 and 34 having a diameter of about $\frac{1}{2}\pm\frac{1}{8}$ inch provides excellent results with conventional trouble lights. A wire having a diameter of between 0.05 to 0.07 inch has been found suitable.

The end portion of each lateral portion 26 and 28 is bent, such as shown by reference number 36. The two similar end portions 36 are bent inwardly in the direction of the recess 30 to grip into parts provided on opposite sides of the plate member 24 so that when the gap between the portions 32 and 34 is spread outwardly by the handle 14, such end portions 36 will tend to grip more strongly inside the parts of the base member 24.

The plate member 24 is essentially made to hold the spring clip member 22 and house a magnet or a pair of magnets 38 and 40. The plate member 24 is essentially flat and has a flat bottom portion 42 for providing a resting surface to the magnets 38 and 40. The upper surface of the plate member 24 has two wing portions 44 and 46. Each wing portion 44 and 46 has a longitudinal groove 48 and 50 for allowing the passage of the lateral portions 26 and 28 and preventing the sideways displacement of the latter. The tip end of each of the lateral portions is bent inwardly towards the recess and inside a part or hole in the wing portions 44 and 46 for preventing the clip to be pulled out and away from the plate member 24. Such an arrangement prevents the clip from any excessive movement whether it is a lateral movement, a longitudinal movement or a rotational movement. The height of the wing portions 44 and 46 does not have to be very long to maintain the wire in its desired position. A wing having a height of about $\frac{5}{8}\pm\frac{1}{8}$ relative to the total height of the spring having a height of $2\frac{1}{2}\pm\frac{1}{4}$ is generally sufficient. As mentioned above, such an arrangement also forces the tip ends 36 inside the holes in the plate member 24 when the gap is stretched out by the entrance or the exit of the handle 14 or the socket 18.

In order to further increase the stability of the clip 22, the recess 30 is formed with a protuberance 52 extending in the direction of the plate member 24. To hold the protuberance 52, the base member is provided with a projection 54 having a slot 55 therethrough. The retention of the protuberance 52 in the slot 55 of the projection 54 increases the stability of the clip and of the trouble light over the plate member 24.

The plate member 24 is preferably made of a plastic housing 56 in which the magnets 38 and 40 are imbedded. A round plate member 24 having a diameter of about 3 inches displays a flat surface 42 of about 2 inches square. Within the perimeter of the 2 inch square, one or a plurality of magnets may be juxtaposed and inlaid into the plastic housing. Magnets such as made of Alnico magnets generally known to include aluminium, nickel and cobalt are preferred. However, ceramic magnets including barium with iron and strontium oxide are sufficient for the present purpose.

In order to help pull away the magnetized plate member 24 from a flat surface to which it has adhered, the plate 24 is preferably provided with beveled surfaces 60–66 for allowing the fingers to grip under the plate 24 and facilitate its removal, that is, for breaking its adherence.

The beveled surfaces 60–66 also have another purpose considering that the flat surface 42 is strongly magnetized, it has a tendency to attract iron based dust which reduces the adherent power of the magnets. Such powder can be easily scraped off the surface 42 by pushing it over the bevelled surfaces 60–66 which have a less adherent power but sufficient to keep the scraped off powder.

I claim:

1. A supporting device for a trouble light having a tubular handle and a light socket axially extending from said handle, said device comprising:

a substantially flat plate member having a magnetized surface and a spring clip member projecting perpendicularly from said plate member in a direction opposite said magnetized surface, said clip member essentially consisting of one continuous resilient wire disposed in a flat narrow plane diametrically crossing said plate member generally defining a M-shape in said plane, said M-shape having two lateral portions and an intermediate portion, said lateral portion being fixed to said plate member on its periphery, said intermediate portion defining a round recess between both of said lateral portions, said intermediate portion leaving a narrowing gap adjacent the lateral portions for allowing access of said handle in said recess, said gap defining a distance smaller than the diameter of said round recess, whereby the introduction of said handle through said gap resiliently spreads the gap due the resiliency of the wire, the latter resiliently gripping the handle along said flat plane when located inside said recess, said magnetized surface adapted to rest on a magnetic surface.

2. A supporting device for a trouble light as recited in claim 1, wherein the wire of the middle section of said intermediate portion forming the recess continuously forms a protuberance outside said recess in the direction of said plate member, means on aid plate for holding said protuberance, whereby said wire is prevented from moving in a direction perpendicular to said plane.

3. A supporting device for a trouble light as recited in claim 1, wherein said plate member is characterized by a hollow housing, a magnet fixed in said housing, a pair of ports in said housing diametrically disposed relative to said plane, said lateral portions adapted to be removably mounted in said ports.

4. A supporting device for a trouble light as recited in claim 3, wherein said lateral portions are terminated by end portions substantially disposed at 90° with the lateral portions, said lateral portions being resiliently biased towards each other and both end portion being directed towards each other, said ports radially extending inside said housing and adapted to receive and hold said end portions.

5. A supporting device for a trouble light as recited in claim 4, wherein said plate member has lateral wing portions disposed adjacent the periphery of said plate member, said wing portions having grooves along said plane for receiving said lateral portions, whereby said grooves are adapted to laterally support said lateral portions of said wire.

6. A supporting device for a trouble light as recited in claim 2, wherein said means is characterized by a slotted projecting member extending in the direction of said protuberance, said slotted projecting member being adapted to transversally retain said protuberance and maintain said wire in said plane.

7. A supporting device for a trouble light as recited in 5, wherein the magnetized surface is substantially flat and is bevelled around its periphery on the side adjacent the magnetic surface to allow the introduction of human fingers between said plate member and said magnetic surface for pulling on the plate member.

8. A supporting device for a trouble light as recited in claim 1, wherein the wire has a diameter of about 0.05 to 0.07 inch.

* * * * *